United States Patent [19]

Smith

[11] 4,272,238

[45] Jun. 9, 1981

[54] INFRA-RED HEATING AND BURNERS

[76] Inventor: Thomas M. Smith, 114 Villinger Ave., Cinnaminson, N.J. 08077

[21] Appl. No.: 94,901

[22] Filed: Nov. 16, 1979

Related U.S. Application Data

[63] Continuation-in-part of Ser. No. 20,079, Mar. 13, 1979, Ser. No. 952,332, Oct. 18, 1978, Ser. No. 863,251, Dec. 22, 1977, Pat. No. 4,224,018, and Ser. No. 775,838, Mar. 9, 1977, said Ser. No. 20,079, and Ser. No. 952,332, is a continuation-in-part of Ser. No. 863,251, , Ser. No. 775,838, , and Ser. No. 906,229, Jul. 1, 1976, abandoned, each is a continuation-in-part of Ser. No. 701,687, Jul. 1, 1976, abandoned, and Ser. No. 775,838, , and Ser. No. 701,687, , each is a continuation-in-part of Ser. No. 674,409, Apr. 7, 1976, Pat. No. 4,035,132.

[51] Int. Cl.[3] ..... F23D 13/12

[52] U.S. Cl. ..... 431/328

[58] Field of Search ..... 431/328, 329

[56] References Cited

U.S. PATENT DOCUMENTS

| | | | |
|---|---|---|---|
| 3,008,513 | 11/1961 | Holden | 431/328 |
| 3,824,064 | 7/1974 | Bratko | 431/328 |
| 4,035,132 | 7/1977 | Smith | 431/328 |

*Primary Examiner*—Carroll B. Dority, Jr.

*Attorney, Agent, or Firm*—Connolly and Hutz

[57] ABSTRACT

Fibrous mat type burner can have mat pieced together with butt joints and very thin layer of resinous sealant uniting the pieces at the joint. Burners with elongated mats are thus readily manufactured, and can be packaged strapped together in pairs face-to-face and enclosed in telescoping carton halves that allow for packaging burners of different lengths. Matrix edges can be held by clamping members that are curved where they engage outer face so that they do not dig into that face, but dig into inner matrix face. Ceramic mats can be mounted around burner so that they are heated by hot burnt gases and their heated faces generate supplemental radiation toward work being heated by burner.

4 Claims, 27 Drawing Figures

Fig. 2.
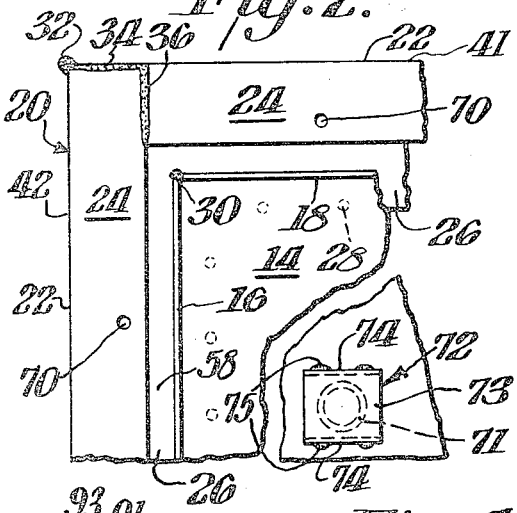
Fig. 4.
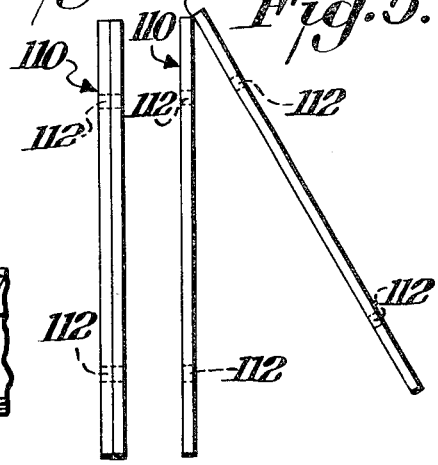
Fig. 5.
Fig. 1.
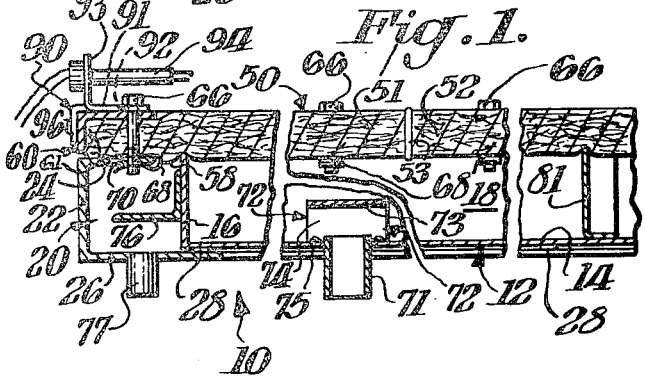
Fig. 3.
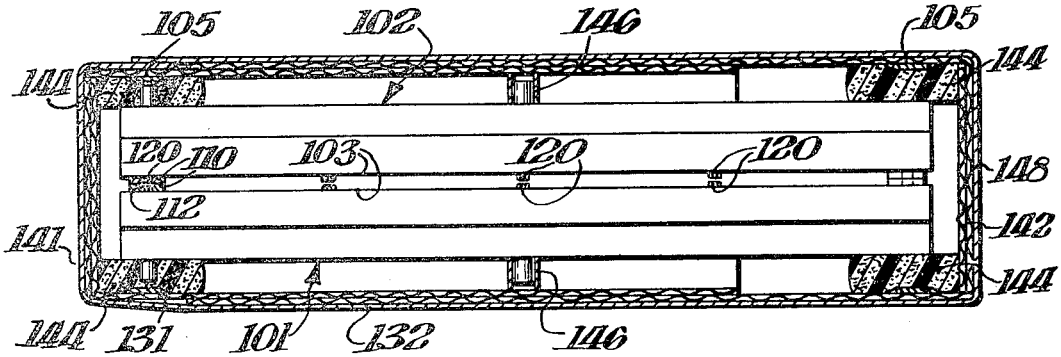

INFRA-RED HEATING AND BURNERS

This application is a continuation-in-part of applications Ser. No. 20,079 filed Mar. 13, 1979, Ser. No. 952,332 filed Oct. 18, 1978, Ser. No. 863,251 filed Dec. 22, 1977 (U.S. Pat. No. 4,224,018 granted Sept. 23, 1980) and Ser. No. 775,838 filed Mar. 9, 1977. In turn, Ser. No. 20,079 and Ser. No. 952,332 are continuations-in-part of each of the other patent applications as well as of application Ser. No. 906,229 filed May 15, 1978 (U.S. Pat. No. 4,157,155 granted June 5, 1979). Applications Ser. No. 906,229, Ser. No. 863,251 and Ser. No. 775,838 are each continuations-in-part of application Ser. No. 701,687 filed July 1, 1976 and subsequently abandoned, and Ser. No. 775,838 and Ser. No. 701,687 are each continuations-in-part of application Ser. No. 674,409 filed Apr. 7, 1976 (U.S. Pat. No. 4,035,132 granted July 12, 1977).

The present invention relates to apparatus for generating infra-red radiation.

Among the objects of the present invention is the provision of improved apparatus for generating and using infra-red radiation.

Additional objects of the present invention include the provision of novel packaging arrangements for such apparatus.

The foregoing as well as additional objects of the present invention will be clear from the following description of several of its exemplifications, reference being made to the accompanying drawings wherein:

FIG. 1 is a sectional view of one form of infra-red generator or burner according to the present invention;

FIG. 2 is a plan view of a corner detail of the burner of FIG. 1, with the upper members removed;

FIG. 3 is a view similar to that of FIG. 1 showing two infra-red generators packaged for shipment;

FIG. 4 is a side view of a packaging strip in the packaging arrangement of FIG. 3;

FIG. 5 is a side view of the packaging strip of FIG. 4, showing the strip partly unfolded;

Figure 3A:
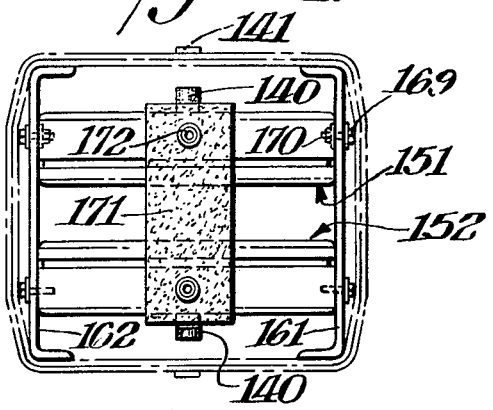
FIG. 3A is a transverse sectional view of a modified burner package assembly typifying the present invention.

The infra-red generators of the present invention have a felted fiber matrix pad with extended surfaces and at least about ½ inch thick, through which pad a gaseous combustion mixture is passed to emerge from one surface and to burn at that surface to heat the surface to incandescence and thus generate infra-red energy. Generators of this type are described in the above-noted parent applications and patents.

The matrix pad for a generator of the foregoing type can consist of at least two separate pieces of matrix butted together in edge-to-edge contact, the abutting edge faces being adhered to each other with a layer of silicone rubber not more than about 3 millimeters thick.

In such a cemented-together matrix pad it is preferred that the pad have its edges clamped in place in the generator, with each separate matrix piece extending to at least one of said edges.

Packaging of elongated burners having matrix pads so long that they are most readily made of adherently united matrix pieces, is greatly simplified by using telescopic packaging cartons. This is particularly desirable when burners of different lengths are being manufactured and are to be packaged for shipment.

According to this aspect of the present invention, two burners are clamped together in parallel with their front faces face-to-face, a first protective tubular carton closely fitted around the strapped-together burners, one end of the tubular carton being open, the other end being closed, another protective tubular carton telescoped over the first tubular carton and also having one end open the other end being closed, the tubular cartons facing in opposite directions and strapped together with their closed ends as the ends of the packaging combination.

Cushioning strip means can be sandwiched between the front faces of the strapped-together burners. Where the front faces of the burners have projecting fastener heads, such as of screws or the like, the cushioning strips used for the packaging are preferably perforated to receive the projecting heads, and thick enough to keep apart the faces and fastener heads of the strapped-together burners. Such cushioning strips are conveniently made of folded-over lengths of corrugated cardboard, but are not needed where the burners are clamped together so that they are held in spaced-apart relation.

Turning now to the drawings, the burner 10 of FIG. 1 has an elongated metal plenum trough 12 whose floor is shown at 14 and side walls at 16, 18. The floor can be 14 by 120 inches in size, by way of example, with side walls 16 then 14 inches long, and side walls 18 120 inches long. The heights of the side walls need only be about 2½ inches or even as little as 1⅜ inches.

Around the periphery of the plenum trough 12 is secured a metal air-seal channel 20 having a web 22 and unequal flanges 24, 26. As illustrated flange 26 is longer than flange 24 and is spot welded by a series of spots, as at 28, to the bottom of plenum trough floor 14.

The corners of the plenum trough and of the air-seal channel are welded together as shown for illustrative purposes in FIG. 2. Weld 30 is a gas-tight joint between side walls 16 and 18. At the burner corner where air-seal webs 22 meet, a vertical weld 32 joins these webs, and additional welds 34, 36 join the flanges 24 together, and while these three welds can also be gas-tight, this is not essential.

The corner construction of the air-seal channel 20 as illustrated in FIG. 2 is made by notching out a square section of web 24 at the end of one rail 41 of the channel, and fitting the un-notched end of the adjacent rail 42 into place. The other flanges 26 of the channel rails can be similarly formed and assembled.

In many cases it is advantageous to use the corner construction of FIG. 2 because square notching can be performed more accurately than mitered notching as shown in U.S. Pat. No. 4,035,132. The product of FIG. 2 will then be simpler to weld together, even though a little extra welding is needed, and will present a better appearance. It is not necessary to weld or otherwise join together the flanges 24, 24 at a corner of the burner body. Indeed by providing a gap between these flanges at those locations the matrix-covering flange of the hold-down frame 20 is better permitted to undergo thermal expansion when the burner is in use, with less warpage of the frame. A similar technique for reducing warpage is shown in U.S. Pat. No. 3,824,064.

If desired the side walls 16, 18 of the plenum trough can have their upper edges provided with a short horizontally extending lip as shown in U.S. Pat. No. 4,035,132, in which event the lip can have a corner construction corresponding to that of the air-seal rail flanges.

Burner 10 has a porous matrix pad 50 positioned over the flanges 24 and upper edges of side walls 16, 18. The matrix pad is clamped in place by a rectangular hold-down frame 60 that extends around the periphery of the pad and is secured to flanges 24 by a series of attaching screws 66. These screws can be threadedly engaged in spring clips 68 fitted over holes 70 in the flanges 24, or in nuts held in these holes by nut-holding clips or the like.

Frame 60 is provided with screw-receiving holes aligned with holes 70, and the screws are drawn up tightly enough to compress the matrix edges as described in Ser. No. 775,838 and substantially reduce the porosity of those edges. The matrix pad is preferably of self-supporting although somewhat resilient construction about an inch or 1⅛ inches thick with its edges compressed down to about 90% of its uncompressed thickness. The frame can have a notched corner construction similar to that of the air-seal rails shown in FIG. 2.

Because of the length of the burner, the matrix pad is made up of two pieces 51, 52, adherently united by a thin layer 53 of silicone rubber sealant. The joint is a simple butt joint and the adhesive layer thickness no greater than about 3 millimeters. The sealant is non-porous, but such a thin layer of sealant blocks off only a small and inconsequential portion of the face of the matrix pad. As a result the slight gap in the area over which the gaseous combustion mixture burns at the outer face of the pad, is of no consequence.

In use the incandescent condition of the surface fibers of the mat on both sides of the sealant layer 53 will cause the outermost portion of that layer to also get very hot and can partially decompose that portion. However the movement of the cool combustion mixture through the inner fibers of the matrix keeps them cool and also keeps the inner portions of the thin sealant layer cool. Thicker sealant layers are not kept so cool and show more thermal degradation. With the 3 millimeter thickness, the adhesive joint need only be about ½ inch deep to have a useful life of many months of operation. Best results are obtained with the adhesive extending the entire depth of the matrix.

The foregoing butt joint is much simpler to make than the tongue-and-groove joint used in the prior art with a sodium silicate type of adhesive deposited from aqueous solution. That prior art type of joint is actually more porous than the adjacent portions of the matrix, and tends to make the generation of infra-red energy much less uniform.

The butt joint can also be modified by connecting together two matrix lengths with the help of a metal foil both faces of which are coated with a thin layer of sealant such as silicone rubber. The overall thickness of the double-coated foil should also be not more than about 3 millimeters, even when the foil is a good heat conductor like aluminum. Some of the foil, with or without coating on it, can be permitted to project into the plenum, but there should be no projection beyond the outer face of the matrix.

As in the constructions of the parent applications, the burner 10 is provided with connection nipples to supply the plenum with combustion mixture and to supply air to the interior of the air-seal channels. A nipple 71 for the plenum is shown as welded into trough floor 14 and a simple deflector baffle 72 welded above it to the inner face of that floor. That baffle is a short length of a channel that has only a body web 73 and two flanges 74, and is very simply tack welded as at locations 75, to the trough floor 14. If desired the baffle can be further simplified, as by making it a metal tab much like the bent tab baffle 76 shown for the air nipple 77, but having the bending angle an obtuse angle. One tab of such baffle can then be spot welded to the top of trough floor 14 alongside the nipple 71, to hold the remainder of the baffle at an angle over that nipple.

More than one combustion mixture supply nipple is used with burners as large as 120 inches. Two such nipples are enough, however, especially if symmetrically located about 60 inches apart along the burner's length, when the plenum is not partitioned into separate compartments. The plenum can be easily partitioned as by welding a sheet metal panel 81 in place in the trough, in which event there should be at least one combustion mixture supply nipple for each plenum compartment.

Panel 81 preferably does not extend into the air-seal channel, and it is not necessary to partition off the air seal, although this can be done as by a similar partition panel, if desired. The air-seal slot 58 by which air is discharged from the air-seal channel through the entire margin of the matrix pad, is preferably kept unobstructed. A gas-tight seal can be provided between partition panel 81 and the walls and floor of the plenum trough, but a simple spot welding is enough if the combustion mixture supply nipples are connected to gas and air sources arranged to supply only air to any plenum compartment that is not being fired while an adjacent compartment is being fired. The air pressure in the unfired compartment can then be made equal to or a little greater than the combustion mixture pressure in the fired compartment, to reduce the danger of combustion mixture leakage around the partition.

For some uses of the burners, they are arranged to generate infra-red energy over a variable length. Thus in the pre-drying of a wet fabric in a textile mill, the fabric processed can sometimes be as narrow as 30 inches or so, and sometimes as wide as 120 inches. The burners can then be partitioned as for example to provide a central plenum compartment 30 inches long, plenum compartments 20 inches long on either side of the central compartment, and plenum compartments 25 inches long at each end of the plenum. The appropriate compartments can then be fired to match the width of the fabric that is passed transversely in front of the burner for exposure to the infra-red energy.

It is preferred to have the hold-down frame 60 so dimensioned that its peripheral flange 61 lies in the same general plane as air plenum web 22 at all sides of the burner. This makes it unnecessary to have flanges 61 accurately located so as to fit around webs 22, and also uses less metal in frame 60.

The air nipple 77 can be mounted in the end wall 22 of the burner instead of in the burner back, if desired, in which case baffle 76 can be eliminated. Also said end placement can be duplicated on both ends of a burner, and the projecting air nipples and/or the pipe connections to them make convenient hanger mountings by which a burner can be held in pipe straps or U-bolts for example. Such pipe straps or U-bolts can slidably hold the nipples or pipe connections, so as to more readily allow for thermal expansion of the burner body as it heats up and cools down.

The matrix pad can have more than one joint 53, and such joints can be located within a few inches of each other, if desired. It is preferred however that each piece of matrix thus joined have an edge secured under the hold-down frame 60. Where the matrix pieces being joined have good edges at the joint, no special preparation is needed. Where those edges are damaged or out of true, they can be readily cut as by a table saw with a fine-toothed saw blade, to provide true edges.

The silicone sealant is sufficiently viscous that it can be spread over a matrix edge without penetrating into the matrix fibers more than about ½ millimeter. Any of the commercially available silicone sealants are suitable. Sealants made of lower temperature non-porous materials such as natural rubber or neoprene or epoxy resins, can be used in place of the silicone sealant but they degrade more severely when the matrix they unite is fired, and so are not preferred. The use of a rubbery sealant such as silicone rubbers is helpful in that the curing of the sealant does not convert it to a hard material that could cause damage to the matrix fibers when the matrix is flexed during handling.

Burners of the foregoing type can be packaged for shipment in the manner illustrated in FIG. 3. Two burners 101 and 102 are secured together with their matrix faces 103 face-to-face. Ordinary steel or plastic strapping 105 can be wrapped around the ends of the assembled burners, tightened and clamped in place, as a convenient way to so secure the burners.

Before assembling the burners in this face-to-face arrangement, it is particularly desirable to insert several cushioning strips 110 between them so as to cushion them against each other. A simple and highly effective cushioning strip construction is shown in FIG. 4 and FIG. 5. It is merely a narrow strip of 3/16 inch thick corrugated cardboard having holes 112 cut through, and scored at 114 so that it folds readily into the doubled-over position shown in FIG. 4. Holes 112 are spaced the same distance as the fastener heads 120 of a burner so that the cushioning strip is readily placed over a pair of such heads and thus holds itself in place until the second burner is placed over the strip.

Strips 110 in doubled-over condition are thick enough, ⅜-inch for example, to hold the burners apart so that they do not directly contact each other. Thus the hold-down frames 122 as well as the fastener heads 120 of the face-to-face burners are kept out of contact. One cushioning strip at each end of a burner is all the cushioning needed between short burners. Longer burners preferably have additional cushioning strips along their long edges.

The burners are desirably manufactured with their fastener heads 120 a standard distance apart, six inches for example, both along the length as well as the width of the burner, so that a single cushion strip configuration can be readily inserted anywhere. Such a cushion strip should have a length no greater than the narrow width of the burner face, and an eleven inch length works well with burners 14 inches wide. The matrix surface of such burners are also generally 11 inches wide and thus coextensive with the cushioning.

After the burners are strapped together the strapped assembly is inserted in a telescoping cushion-walled carton made of two tubular carton sections 131, 132. These sections are preferably of folded and pasted corrugated cardboard construction each having one end of its tubular length closed by an end wall 141, 142 respectively, the opposite ends of the tubular carton sections are open.

Packaging pads 144, of plastic foam for example, are best positioned under straps 105 and thus held so that they project beyond the longitudinal ends of each burner and the burner assembly does not tend to damage the end walls of the carton sections. Tubular protector sleeves or caps 146 can be placed over projecting nipples to protect them as well as keep them from damaging the adjacent carton walls. Pads 144 project beyond the backs of the burners a distance greater than the nipples, preferably as far as sleeves 146, and are readily penetrated by any air-seal nipples that they cover. These pads are thick enough to extend beyond the outer ends of such nipples.

The cartoned assembly can now be strapped together, as shown by strapping 148, and will withstand very rough handling.

The telescoping character of the carton sections permits the same pair of carton sections to be used to package burners of different lengths so long as their widths and depths are about the same. This is important because the burners are generally of about the same widths and depths but are required to have specific lengths which can vary widely from one installation to another. The burners are generally used in pairs, both burners of a pair being identical in length as well as in width.

Figure 3B:
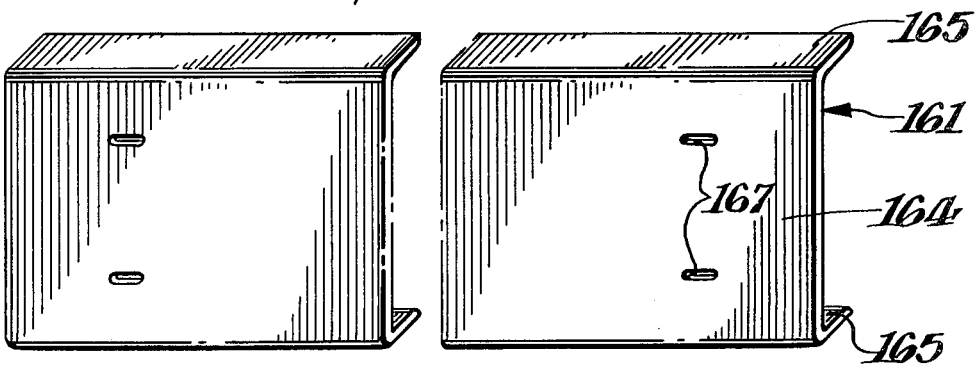
FIG. 3B is an isometric view of a clamping member in the assembly of FIG. 3A.

A more preferred packaging technique is illustrated in FIGS. 3A and 3B. Here burners 151, 152 are clamped in spaced-apart condition by means of clamping channels 161, 162, one of which is shown in greater detail in 3B. These channels have a central web 164 and flanges 165, 165. The webs 164 are wide enough, generally about 10 to 12 inches, to hold the burners apart by at least ¼ inch and hold their flanges 165 in a location beyond the furthest reach of the burner back, and of any projection therefrom, such as combustion mixture nipples 140.

Webs 164 are also punched to provide clamping slots 167 through which screws 169 are inserted and screwed into the body wall of each burner. To help receive these screws the body wall can be fitted with unthreaded or threaded openings, as by punched-out holes into which are set riv-nut type threaded sockets 170. Such sockets can be open at both ends, in which event the screws 169 can be used to close off the sockets when the burners are unclamped and placed in service. Alternatively the sockets can have their inner ends closed so that little or no air-seal gas will leak past them through the holes in which they are fitted.

The flanges 165 need only be wide enough to give the channels the desired rigidity and provide a surface against which the inner cartons 131, 132 are supported. A flange width of about 2 inches is adequate, but greater widths can be used with burners that are wider than the usual 12 to 14 inches. Cold-rolled plain carbon steel sheets about 60 mils thick are very inexpensively punched and shaped into the desired channels and work very well.

The FIG. 3A assembly does not require the strapping of the burners together before cartoning, so that the only strapping can be that applied around the cartoned assembly as shown at 141. Before cartoning however a cushion block 171 can be placed over the air-seal nipples 172 if those nipples project longitudinally from the burner ends. The cushion block can be a fairly stiff plastic foam such as polystyrene foam, and can have openings torn or punched out to receive nipples 172 and thus reduce the possibility of having those nipples tear out portions of the foam that might lodge themselves in the air seal plenum.

The strapping 141 can extend longitudinally or transversely of the burner lengths. Also screws 169 can if desired be of the flat-head type fitted into slots 167 that taper to match the tapered sides of the flat-heads or such screws, to thus reduce the projection of the screw heads against the cartons.

At least one pair of clamping channels 161, 162 should be used, but where the channels are much shorter in length than the burners, two pairs of such channels are preferred, one pair near each end of the burner assembly.

The burners can be provided with any desired ignition means, such as a pilot flame or electric sparking. In FIG. 1 a spark ignition attachment is shown as a bracket 90 having a web 91 with a mounting hole or slot 92 for insertion under the head 66 of one of the fasteners. A flange 93 bent out from one portion of web 91 has a mounting hole or slot for holding a spark ignitor 94 so that its sparking end is located over the matrix portion through which the combustion mixture passes. Another flange 96 can be provided to engage the side of the hold-down frame 60 and thus more positively located the ignitor. Other types of ignitors are shown in parent application Ser. No. 952,232.

The ignitors can be readily installed in the field, and are accordingly not needed to be packaged in the packaging arrangement of FIG. 3. However that packaging provides empty spaces between the cartoning and the backs of the burners, and a separate envelope containing ignitors or ignitor parts can be fitted in those spaces.

The burners of the present invention can have a flat matrix face, as in FIGS. 1 and 3, or a concave or convex matrix face, as described in the parent applications. The concave type matrix face radiates energy that can be highly concentrated in a limited area, and is particularly suitable for heating such areas to very high temperature, or for very rapidly heating up such areas. An example of such rapid heating up is described in Ser. No. 701,687, abandoned.

Figure 6:
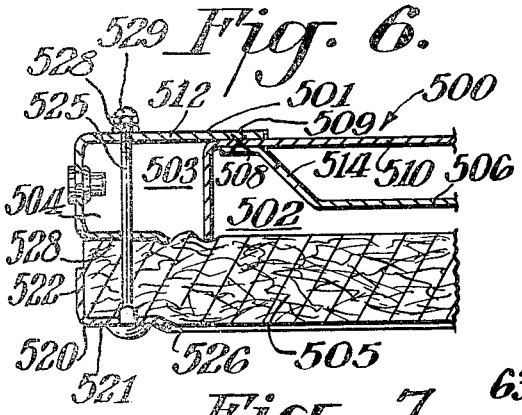
FIG. 6 is a fragmentary sectional view of a further modified burner in accordance with the present invention.
Figure 7:
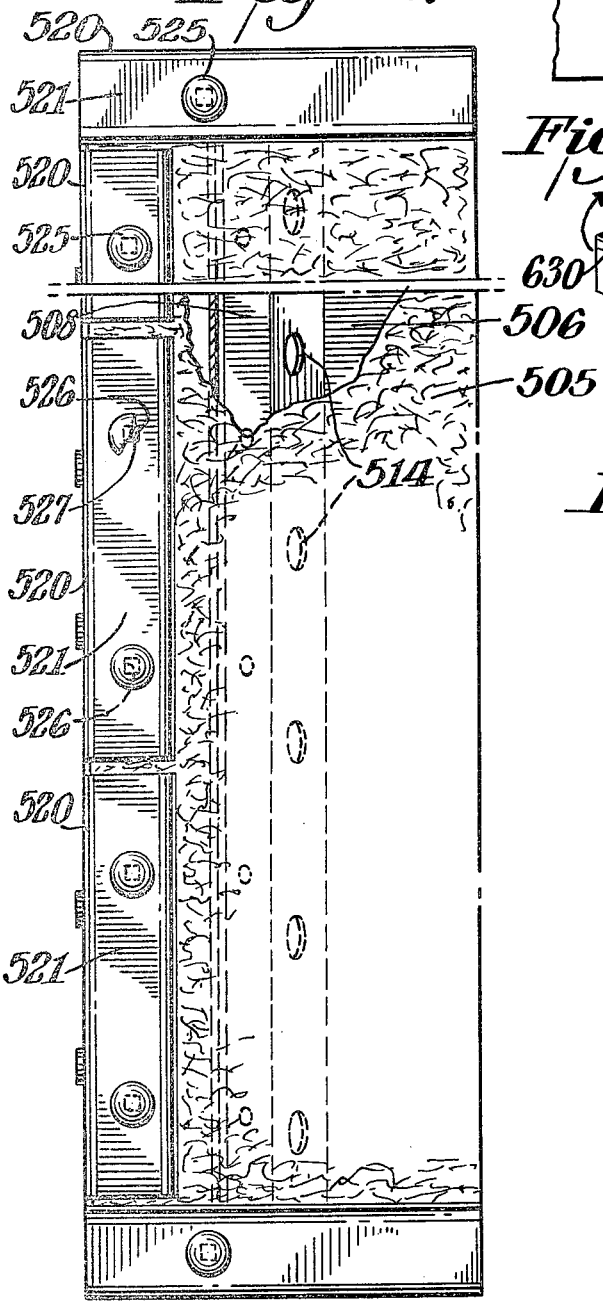
FIG. 7 is a plan view of the burner portion of FIG. 6.

The burner 500 of FIGS. 6 and 7 is a particularly preferred construction for burners that are very long—for example four feet long or longer. This construction is very much like those of FIGS. 1 and 3, having a burner body 501 with a combustion mixture plenum 502, an air-seal plenum 503, and a matrix-supporting shelf 504 engaging a matrix 505. Within the combustion mixture plenum 502 a diffuser 506 covers the combustion mixture inlet and extends the length of the plenum. Diffuser 506 is preferably cold-rolled plain carbon steel sheeting about 0.050 inch thick bent into the shape of a trough with side flanges 508 spot-welded as at 509 to the floor 510 of plenum 502. The spot welds 509 are shown as made so that they also weld in place the flange 512 of the air-seal plenum channel, and a single spot weld welds flanges 508 and 512 to floor 510.

The diffuser has a series of apertures 514 in its side walls to permit free passage of combustion mixture to the matrix. Another desirable feature of the diffuser is that it can be kept relatively cool by the incoming combustion mixture, and when used with a burner body having an air-seal periphery will keep that body from excessive thermal expansion even without thermal blanketing of that body. Such expansion can operate to pull the matrix apart, inasmuch as the matrix edges are tightly clamped to the body shelving and the incandescent face of the matrix is not very resistant to stretching. The full-length diffuser 506 also greatly stiffens the burner so that little or no external stiffening is needed even for burner bodies as much as 12 feet long. Alternatively the burner body can be made relatively thin, as from 0.050 inch thick sheet metal.

It is not desirable to reduce the matrix edge clamping so as to permit the matrix edge to slidably adjust themselves on the shelves 504. Quite the contrary it is helpful to lock the matrix edges in place, as by curling out the edge of the shelf 504, as shown in FIG. 6, so as to cause that edge to dig into the back of the matrix. Only about 1 to about 5 millimeters of the shelf width at its inboard edge is all that need be so curled, and only about 1 to about 2 millimeters of outward projection of the curled edge is adequate.

The burner of FIG. 6 is well adapted to operate face down, and to this end has its matrix clamped in place by a series of relatively short hold-down angles 520 spaced from each other by about 1/16 to about ¼ inch. The hold-down face flanges 521 of these angles will get relatively hot in use and the spacings permit those flanges to undergo thermal expansion without much warpage, so that the matrix remains securely held.

A particularly effective form of hold-down angle 520 has the inboard edge of its face flange 521 curled out about the same way as described for the shelf 504. This keeps that flange from digging into the face of the matrix where such digging can cause premature failure of the matrix. Angles 520 are shown as clamped by carriage bolts 525 the square shanks 526 of which are received in square holes 527 punched in flanges 521. The carriage bolts also extend through round holes 528 in shelves 504 and in back flange 512, and are drawn up tight by a plain nut 528 which can be backed by an acorn nut 529 that covers the relatively sharp bolt end with a rounded surface that keeps those ends from tearing anything they happen to contact.

Hold-down angles 520 are preferably about 6 to about 12 inches long, each equipped with two bolt-mountings. Also they appear to work better when made of relatively thick sheet metal, e.g. at least about 0.070 inch thick. The burner body generally need be no thicker than about 0.060 inch. Flanges 522 on these angles need only be about ⅝ inch wide.

Figure 8:
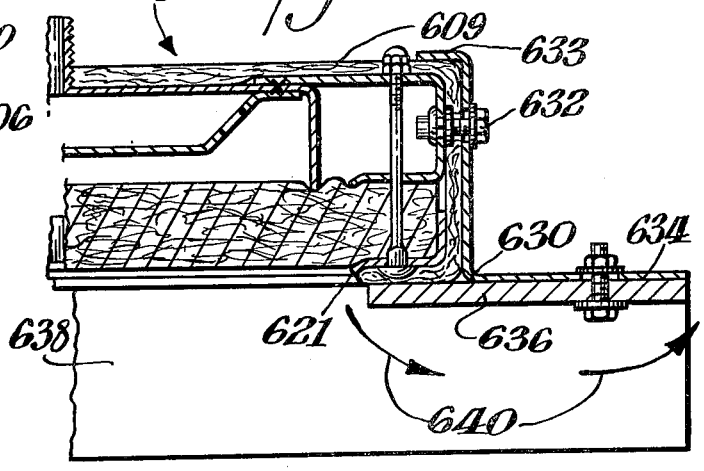
FIG. 8 is a view similar to that of FIG. 6 of a still further burner construction representative of the present invention.
Figure 9:
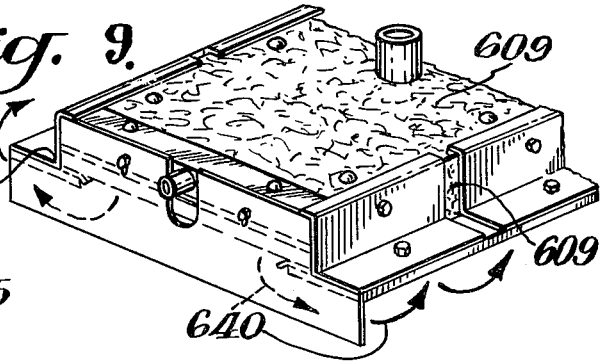
FIG. 9 is a perspective view of the burner portion of FIG. 8.

The burner 600 of FIGS. 8 and 9 is shown as the burner 500 provided with thermal insulation blanketing 609. The blanketing extends transversely across from the hold-down flanges 621 along one long side of the burner over the burner back and over to the opposing hold-down flanges. The ends of the blanketing are shown as held in position by a series of metal wings 630 fastened to the burner body as by bolts or screws 632 in a manner similar to the fastenings 169 of FIG. 3A.

Wings 630 also shown as having outwardly extended arms 634 to which a sheet of additional thermal insulation 636, preferably molded into a self-sustaining block, can be mounted to face the work being irradiated by the incandescent face of the matrix. The block or blocks 636 can thus be similar to the matrix, but they do not have to withstand the same high temperatures. In use hot combustion gases generated at the incandescent matrix face flow out over the blocks 636 and heat the outer faces of the blocks hot enough to cause those faces to materially add to the irradiation from the matrix. A block width of at least about 1 inch is needed to this end, and blocks as much as 5 inches wide are particularly effective.

Wings 630 are shown in FIGS. 8 and 9 as provided with positioning flanges 633 that engage the back of the burner or the insulation covering that back. However these positioning flanges can be omitted.

The blanketing 609 in FIG. 9 is shown as extending the entire length of the burner, but not over the flanges 621 of the hold-down angles at the burner ends. Instead those ends are covered by deflector panels 638 of sheet metal, for example, that project down below the insulation blocks 636 and keep the hot combustion gases from escaping over those ends. As indicated by the arrows 640 those gases are thus guided over the insulation blocks 636 to cause those blocks to improve their heating effects.

If desired, panels 638 can have tabs struck out from their flat bodies to project over hold-down flanges 621 at the burner ends and hold thermal blanket sections over those flanges. Elongated burners are generally used to irradiate work that is passed transversely to their length and that does not extend beyond the ends of the burner. In such an arrangement there is not much to be gained by mounting wings 630 along those ends.

Figure 10:
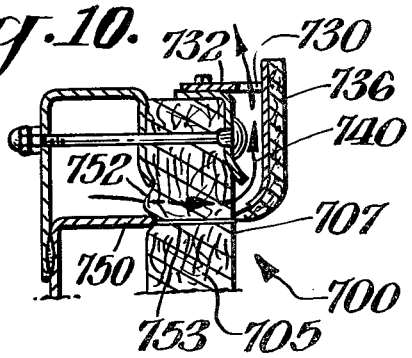
FIG. 10 is a sectional detail of yet another burner construction incorporating the present invention.

FIG. 10 shows a modified form 700 of the burner construction of FIGS. 6 and 8. Here the relatively cold air-seal gases discharged through the burner's matrix face are deflected away as shown by arrows 740, so that they do not significantly detract from the heating of a thermal block 736 mounted over the burner's edge. Block 736 is held, as by cementing, to a metal support 730 that has tongues struck out to form mounting lugs 732 by which the support is secured to the hold-down angle or to the burner side.

Block 736 is preferably arranged so that its inboard end touches the face 707 of matrix 705 at a location at which combustion mixture does not emerge from that face. That location is generally directly opposite the edge 750 that defines the inboard boundary of the air seal slot 752, but to make more certain of the location the matrix can be provided with an impervious internal stratum 753 that provides a barrier against spreading of the combustion mixture beyond the proper location. This barrier 753 can be a silicone rubber or other plastic layer provided the same way as the joint 53 in the construction of FIG. 1 with or without the help of a metal foil.

The burner of FIG. 10 is shown as operating with its matrix held in the vertical position, but it is also very well suited for operating face down. Similarly the burners of FIGS. 6 and 8 can also be operated facing laterally like the burner of FIG. 10.

Obviously many modifications and variations of the present invention are possible in the light of the above teachings. It is therefore to be understood that within the scope of the appended claims the invention may be practiced otherwise than as specifically described.

What is claimed:

1. In an infra-red generating burner having a metal combustion mixture plenum covered by a porous refractory panel through which the combustion mixture is passed on the outer face of which that mixture burns, and also having a gas-supply conduit encircling the plenum for supplying a stream of non-combusting gas to be discharged around the face of the burner, the improvement according to which the encircling conduit is defined between the outer faces of the plenum and the inner faces of open angular metal members encircling the plenum, and those metal members are spot welded to the back of the combustion mixture plenum by a series of spot welds.

2. The combination of claim 1 in which the spot welds of the series of spot welds are spaced from each other.

3. The combination of claim 1 in which the spot welds also weld a metal diffuser to the internal face of the plenum floor.

4. The combination of claim 3 in which the burner has an elongated shape at least four feet long, and the spot-welded diffuser is a stiffener that extends the length of the plenum.

* * * * *